US006929147B2

(12) United States Patent
Guillemette et al.

(10) Patent No.: US 6,929,147 B2
(45) Date of Patent: Aug. 16, 2005

(54) MODULAR DISPENSER

(75) Inventors: Philippe Guillemette, Caen (FR); Jean-Louis Neveu, Colmar (FR)

(73) Assignee: Georgia-Pacific France, Kunheim (FR)

( * ) Notice: Subject to any disclaimer, the term of this patent is extended or adjusted under 35 U.S.C. 154(b) by 59 days.

(21) Appl. No.: 10/245,314

(22) Filed: Sep. 18, 2002

(65) Prior Publication Data

US 2003/0057221 A1 Mar. 27, 2003

(30) Foreign Application Priority Data

Sep. 25, 2001 (FR) ..... 01 12324

(51) Int. Cl.[7] ..... A47K 10/24

(52) U.S. Cl. ..... 221/45; 220/4.01; 221/59; 221/62

(58) Field of Search ..... 220/4.01–4.03, 220/4.33, 578, 622; 221/45, 59, 33, 56, 282, 303

(56) References Cited

U.S. PATENT DOCUMENTS 2,591,172 A * 4/1952 Lundine ..... 312/263
3,258,649 A * 6/1966 Arguin et al. ..... 361/807
3,450,293 A * 6/1969 Seda et al. ..... 220/4.28
4,471,898 A * 9/1984 Parker ..... 228/20.5
4,679,703 A 7/1987 De Luca
4,942,271 A * 7/1990 Corsi et al. ..... 174/101
4,953,747 A 9/1990 Wenkman et al.
5,076,466 A * 12/1991 Petterson et al. ..... 221/46
5,378,854 A * 1/1995 Hoover ..... 174/53
5,797,542 A * 8/1998 O'Connor ..... 229/109
6,170,687 B1 * 1/2001 Griffin et al. ..... 220/4.33

FOREIGN PATENT DOCUMENTS

EP 0 506 2438 A1 9/1992

* cited by examiner

*Primary Examiner*—Joseph C. Merek
(74) *Attorney, Agent, or Firm*—Breiner & Breiner, L.L.C.

(57) ABSTRACT

A modular dispenser of sheet products including an open-ended case (10), a front panel (20), and a rear panel (30) is characterized in that the open-ended case is fitted with first longitudinal ribs (11, 12) by which the front and rear panels are kept in place on the open-ended case. In particular, the open-ended case includes a set of ribs providing the function of guidance, assembly and closing.

6 Claims, 2 Drawing Sheets

MODULAR DISPENSER

FIELD OF INVENTION

The present invention relates to a dispenser of sheet products. In particular it concerns a dispenser of cellulose wadding, hereafter tissue paper, items.

BACKGROUND OF INVENTION

Presently public places, such as restaurants, make available to the consumers dispensers of tissue paper items such as table napkins, towels or sanitary paper.

In general, a napkin dispenser is made up of a substantially parallelipipedic open-ended case including a front panel fitted with a transverse slot through which the napkins are extracted. The napkins are assembled as a pack inside the dispenser either in a mere juxtaposed manner or independently of each other or interleafed with each other.

The dispensers can be set down flat or vertically against a wall.

The dispenser size interacts with the size of the corridor/aisle of the premises. In particular the dispenser if made small must be reloaded frequently. The supplier of such dispensers always attempts providing his clients with designs suitable for their purposes, however he also must take into account the consequent large number of designs entailing management costs and the costs of manufacture. Moreover, these dispensers require a bulky storage space.

Accordingly, a dispenser of which the dimensions may be freely selected without entailing excessive costs is desirable.

OBJECTS AND SUMMARY OF THE INVENTION

The invention attains this objective using a modular dispenser comprising a tubular open-ended case, a front panel fitted with a dispensing slot, and a rear panel, the dispenser being characterized in that the open-ended case comprises first longitudinal ribs with which the front and rear panels are affixed to the open-ended case.

Thanks to this solution of the invention, a dispenser of the desired capacity can be suggested to the client, where the dispenser exhibits a cylindrical or U-shaped open-ended case of appropriately selected length. In particular, the length can be selected without detriment to the affixation means because the end panels are fastened on longitudinal ribs.

These ribs not only allow simple assembly but also they offer the advantage of bracing the walls. As a result, the walls can be made thinner and material savings are obtained.

In another feature of the invention, the open-ended case comprises a detachable panel on one of its sides and is fitted with a second rib cooperating with a rib rigidly joined to the detachable panel. In particular one of the two ribs exhibits an arcuate cross-section, the other rib exhibiting a cross-section in the form of a disk segment in order to constitute a hinge.

In still another feature of the invention, the open-ended case comprises third ribs guiding a transverse panel in the space within the two front and rear panels.

In yet another feature of the invention, the open-ended case comprises fourth ribs guiding a return spring of the transverse panel.

In another feature of the invention, the ribs run longitudinally over the full length of the open-ended case.

In another feature of the invention, the open-ended case consists of two right-angle plates assembled to form a U. In particular the two plates are held together by two elements constituting ribs.

In another feature of the invention, the open-ended case comprises ribs in particular on its inside surface to implement the functions of guidance, assembly and closing.

The invention furthermore relates to a method for manufacturing a dispenser, the method being characterized in that a segment forming the open-ended case is cut off an extruded basic part comprising longitudinal ribs on its inside and in that a panel fitted with a dispensing slot is affixed to one end of the ribs and another panel is affixed to the other end.

In another feature of the invention, the extruded basic part is trough-shaped and is fitted with a longitudinal rib near one free edge on which, following cutting off, a detachable panel hinging about the free edge shall is affixed.

In another feature of the present invention, two right-angle plates are cut off from two right-angle extruded basic parts and are assembled to form the open-ended case.

Other additional features and advantages are elucidated in the description below of a non-limiting embodiment of the invention and in relation to the attached drawings.

DETAILED DESCRIPTION OF THE PRESENTLY PREFERRED EMBODIMENTS

Figure 1:
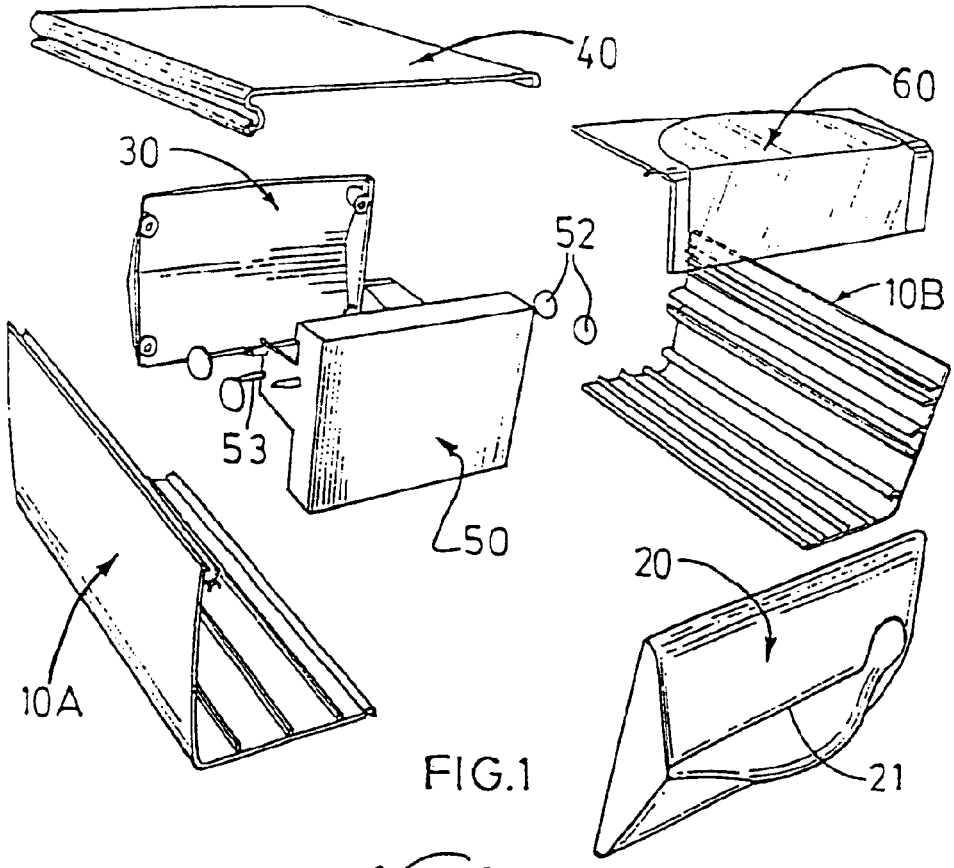
FIG. 1 is an exploded perspective of a dispenser of the invention.

FIG. 1 is an exploded view of a preferred embodiment of the invention. The dispenser consists of two components 10A ands 10B, of a front panel 20, a rear panel 30, an upper panel 40, a push panel 50, and optionally, a transparent window 60 completing the wall of the upper panel. Once these components are assembled, they constitute an open-ended case receiving tissue paper articles, in particular table napkins. The napkins are configured parallel to the front panel which is fitted with a dispensing slot 21 through which the napkins can be extracted. The napkins are kept against the front panel 20 by the push panel 50 that is loaded by return springs mounted in the walls of the open-ended case 10.

Figure 2:
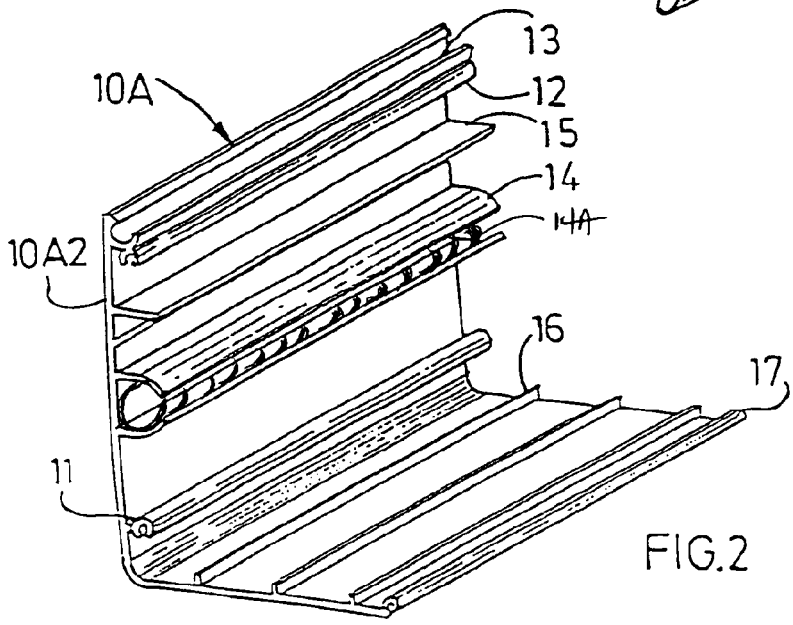
FIG. 2 is a perspective of part of the open-ended case of the dispenser of FIG. 1.

FIG. 2 shows the component 10A of the open-ended case 10. This component 10A assumes the form of a right-angle plate with one leg assigned to be the bottom and the other leg to be a sidewall. First longitudinal ribs 11 and 12 are part of the leg 10A2 constituting a sidewall and running from one end to the other of the right-angle plate. The illustratively cross-sectionally circular cylindrical ribs allow passing through their ends screws that are turned to keep the panels in place. The rib 13 near the upper edge of the right-angle plate exhibits an arcuate cross-section to receive a complementary rib on the panel 40. The rib 14 is a dual one, being shaped to house a helical spring 14A which is longitudinally displaceable in it. However this spring can be replaced by any other equivalent resilient means that applies a longitudinal return load. The rib 15 guides and supports small wheels or skids mounted on the push panel. There are three ribs 16 on the bottom-constituting leg of this embodiment and they support the napkins in the dispenser and, in particular, they substantially reduce friction between the napkins and the box while bracing the wall. At the other free edge of this right-angle plate, an end rib 17 cooperates with a rib 10B to form a locking means.

Figure 3:
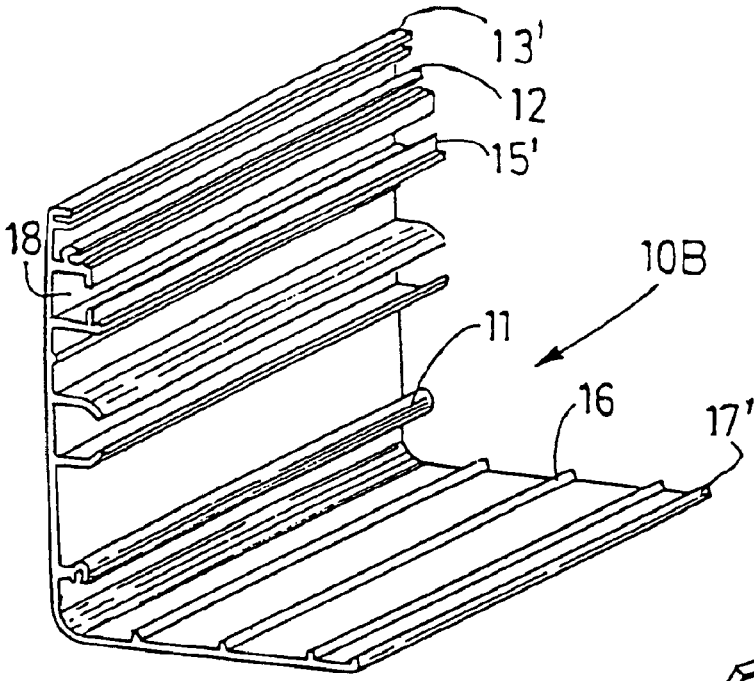
FIG. 3 is a perspective of the complementary part of the open-ended case of the dispenser of FIG. 2.

The component 10B shown in FIG. 3 is symmetrical with the first component except for the ribs of the free longitudinal edges. The shape of the rib 17' is complementary to that of the rib 17 which is beaded and these two ribs can be mutually engaged by using the rib 17 as the housing. The rib 17 is engaged by the rib 17' sliding into it from one end. Be it noted that the rib 15' is dual. Its lower side guides the push element 50. Its upper side acts as a slide 18 to house a not shown locking element locking the upper panel 40 of which the free edge rests against the upper free edge 13' of the side leg. Preferably the locking element is a clip with elastic legs.

Figure 4:
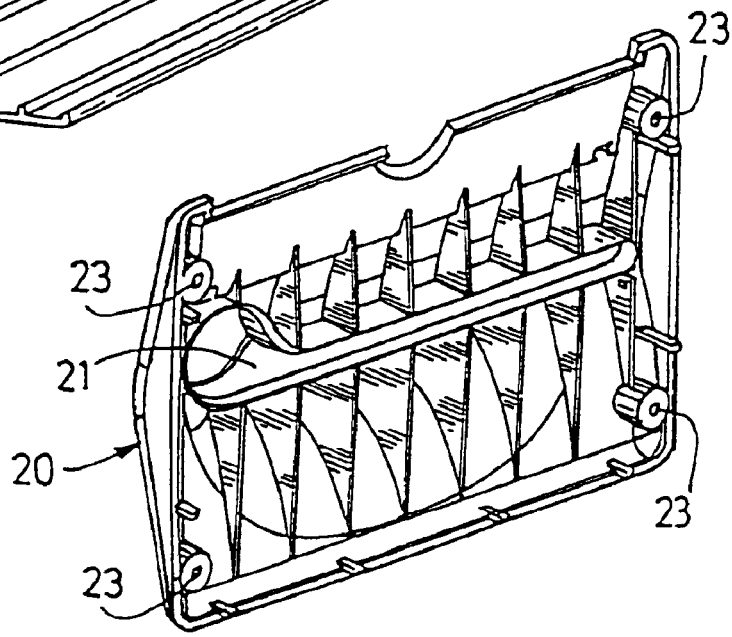
FIG. 4 is a perspective of the front panel.

The front panel 20 is shown as seen from its inner surface in FIG. 4. There are four seats 23 for affixation screws at the four corners. These seats are the same height as the ribs 11, 12. A screw inserted from the outside can be engaged in this manner into the end aperture of each of the ribs.

The rear panel is not shown in detail because it comprises the same seats near the edges for screw affixation to the ribs 11 and 12.

Figure 5:
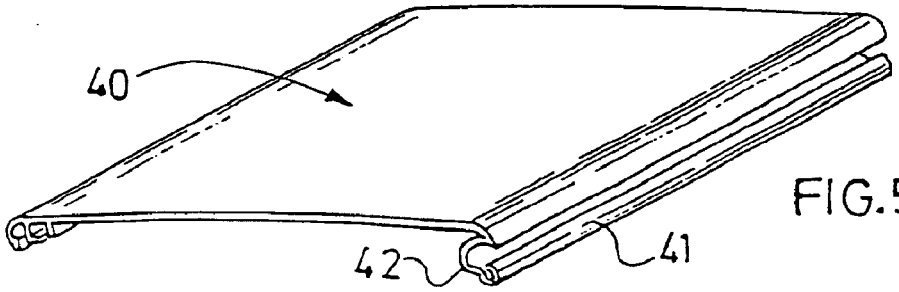
FIG. 5 is a perspective of the upper panel.

FIG. 5 shows the upper panel 40. A rib 41 runs along a longitudinal edge. The rib's shape complements that of the rib 13 of the component 10A. Once engaged one in the other, the panel 40 will be pivotable about the upper edge of the component 10A. A recessed segment 42 of the cross-section of the rib 41 acts as a stop and limits the excursion of the panel 40. The opposite edge is fitted with a dual rib which cooperates with the above mentioned clip. The rear wall of this dual rib limits the rearward displacement of the clip's elastic legs. The push panel 50 is fitted on each side with small wheels 52 and with a stud 53 to which is affixed the end of the return spring.

Preferably the components 20, 30, 50 and 60 are made by conventional molding. The components 10A, 10B and 40 preferably are extruded through an appropriate die using a material such as aluminum. The manufacture of a dispenser only requires the elements 10 and 40 be made by cutting to size the extruded basic parts.

Thereupon the components are assembled to one another in the manner suggested in the exploded view of FIG. 1. First the open-ended case 10 is assembled by inserting the rib 17' of the right-angle plate 10B into the rib 17 of the right angle plate 10A. The upper panel 40 is put in place by sliding the ribs 13 and 41 one into the other. The not shown locking element is inserted in the slide fitted on the upper edge of the rib 15'. The push panel 50 is put in place with its small wheels 52 resting against the guide surfaces constituted by the ribs 15 and 15' and the two return springs inside the ribs 14 of which one end is affixed to the stud 53, furthermore the optional window 60.

Lastly, the open-ended case is closed by means of the panels 20 and 30 which are affixed by screws inserted from the outside into the seats 23 as far as into the tubular ribs 11 and 12.

In this manner a rugged dispenser is achieved of which the capacity can be selected according to need, and which comprises a reduced number of parts, and which is economical as a whole. The components can be stored separately and assembled as needed. The person implementing such an assembly can have access to extruded basic parts precut to the right length or can himself cut the extruded basic parts to the desired length.

It is claimed:

1. A modular dispenser of sheet products comprising an open-ended parallelipipedic case, a front panel a transverse panel, and a rear panel, wherein said open-ended case comprises at least two first longitudinal ribs adapted to hold said front panel and said rear panel in place on said open-ended case, a second longitudinal rib cooperating with a rib joined to a top detachable panel, one of said second longitudinal rib or said rib joined to said top panel having an arcuate cross-section, and the other has a cross-section in a form of a disk portion to constitute a hinge, so that said top panel is pivotable about said second longitudinal rib, said longitudinal ribs extending over the full length of said open-ended case and wherein said open-ended case is constructed and arranged so that said transverse panel is biased for movement towards said front panel.

2. Dispenser as claimed in claim 1, wherein the open-ended case comprises third longitudinal ribs adapted to guide the transverse panel between the front panel and the rear panel.

3. Dispenser as claimed in claim 2, wherein the open-ended case further comprises fourth longitudinal ribs adapted to guide a return spring which loads said transverse panel.

4. Dispenser as claimed in claim 1, wherein the open-ended parallelipipedic case comprises two components, each component in a shape of a right angle plate.

5. Dispenser as claimed in claim 4, wherein the two components are kept assembled to each other by means of two longitudinal ribs.

6. Dispenser as claimed in claim 1, wherein said open-ended case comprises ribs which together provide functions of guidance, assembly and closing.

* * * * *

UNITED STATES PATENT AND TRADEMARK OFFICE

CERTIFICATE OF CORRECTION

PATENT NO. : 6,929,147 B2
APPLICATION NO. : 10/245314
DATED : August 16, 2005
INVENTOR(S) : Philippe Guillemette et al.

It is certified that error appears in the above-identified patent and that said Letters Patent is hereby corrected as shown below:

Column 4,
Line 21, "A front panel" should read -- a front panel, --.

Column 4,
Line 32, "open-ended case" should read --open-ended case, --.

Signed and Sealed this

Fifteenth Day of August, 2006

JON W. DUDAS
*Director of the United States Patent and Trademark Office*